US009299471B1

(12) United States Patent
Robb et al.

(10) Patent No.: US 9,299,471 B1
(45) Date of Patent: Mar. 29, 2016

(54) HIGHLY RESISTIVE WIRING FOR INHERENT SAFETY FROM ELECTROMAGNETIC THREATS

(75) Inventors: Andrew M. Robb, Ravensdale, WA (US); Jason P. Bommer, Tacoma, WA (US); Donald K Dabelstein, Renton, WA (US); James Irwin, Renton, WA (US)

(73) Assignee: The Boeing Company, Chicago, IL (US)

( * ) Notice: Subject to any disclaimer, the term of this patent is extended or adjusted under 35 U.S.C. 154(b) by 403 days.

(21) Appl. No.: 12/924,287

(22) Filed: Sep. 23, 2010

(51) Int. Cl.
*H01B 1/00* (2006.01)
*H01B 1/04* (2006.01)

(52) U.S. Cl.
CPC ... *H01B 1/00* (2013.01); *H01B 1/04* (2013.01)

(58) Field of Classification Search
CPC ..... H01B 1/04; H01B 1/122; H01B 1/18; H01B 1/19; H01B 1/127; H01B 1/20; H01B 1/24; H01B 7/0054; H01B 7/17; H01B 7/18
USPC ..... 174/102 SC, 124 R, 126.4; 338/214; 361/215
See application file for complete search history.

(56) References Cited

U.S. PATENT DOCUMENTS

| | | | | |
|---|---|---|---|---|
| 3,641,439 | A | 2/1972 | Aslan | |
| 3,690,057 | A | 9/1972 | Norris | |
| 3,794,914 | A | 2/1974 | Aslan | |
| 4,237,731 | A | 12/1980 | Dehn | |
| 4,301,428 | A * | 11/1981 | Mayer | 333/12 |
| 4,553,216 | A * | 11/1985 | Stevens et al. | 702/55 |
| 4,748,436 | A | 5/1988 | Kanamori et al. | |
| 4,753,088 | A | 6/1988 | Harrison et al. | |
| 5,101,190 | A * | 3/1992 | Bullock et al. | 338/214 |
| 5,414,216 | A * | 5/1995 | Swift et al. | 174/124 R |
| 7,802,753 | B2 * | 9/2010 | Tichborne et al. | 244/1 A |
| 2004/0020681 | A1 * | 2/2004 | Hjortstam et al. | 174/102 SC |
| 2007/0129902 | A1 * | 6/2007 | Orbell | 702/55 |

* cited by examiner

*Primary Examiner* — Hoa C Nguyen
*Assistant Examiner* — Christopher L Augustin
(74) *Attorney, Agent, or Firm* — Armstrong Teasdale LLP

(57) ABSTRACT

A highly resistive wire includes a non-metallic wire material having a resistance of at least ten kilo-ohms per meter. In one embodiment, the wire material can be fashioned from a carbon-loaded plastic material, having an inclusion of carbon particles in a quantity that yields a resistance of no less than 10 kilo-ohms per meter. In another embodiment, the wire can include a plurality of strands of wire material where each of the strands is surrounded by a thin layer of conductive or semi-conductive material. The highly resistive wire can be used as a single strand, or as a bundle of strands, as wiring in a structure prone to transient electrical or electromagnetic events, such as static discharge or lightning strikes, that might otherwise lead to damage of the structure.

20 Claims, 3 Drawing Sheets

HIGHLY RESISTIVE WIRING FOR INHERENT SAFETY FROM ELECTROMAGNETIC THREATS

FIELD OF THE DISCLOSURE

The present disclosure is directed to a method and apparatus for preventing electrical arcing or sparking in volatile environments, such as in fuel tanks, typically due to lightning and other transient electric energy, and more particularly to a method and an apparatus for disposing wiring in, and in the vicinity of, structural elements, including enclosures housing volatile materials, while ensuring a spark free environment.

BACKGROUND OF THE DISCLOSURE

High power transient events, such as lightning strikes, electrostatic discharge, Electromagnetic Pulses, and Directed Energy Weapon energy, can induce large currents on conductive wiring. This problem becomes compounded when the wiring is installed in less conductive structure such as carbon composite materials as are being widely adopted in the aerospace industry. When conductive wiring is located in explosive or otherwise volatile environments, such as in fuel tanks, the design considerations must take into account product safety and robustness. This is because when high power transient events occur, the wiring can experience and conduct currents up to thousands of amperes.

Many applications of in-tank wiring can typically operate on very small electrical currents (on the order of tens of milliamps or lower), and thus the current capacity of their wiring does not play such an all-important role in their design. However, in situations where the wiring is so proximate to the volatile environment, it becomes far more prudent to use highly resistive wiring that is inherently immune from arcing or sparking.

Moreover, in typical in-tank wiring, the conductive wires are secured to the enclosure walls via nonconductive posts or spacers so that the wires are spaced from and do not lay against the enclosure walls. This technique for installation physically and electrically separates the wiring from the structure to reduce the risk of electrical arcing and sparking in the event of lightning or other high energy transients. This requires additional weight and labor during the build process of aircraft fuel tanks, and such installations require periodic maintenance checks to ensure the nonconductive spacers are free from contamination and the wiring is still secure.

Wiring installed in fuel tanks is not the only wires of concern during lightning strike. A common practice in the aerospace industry is to embed conductive wiring in the bulk of their composite structures. This conductive wiring acts as a continuity sensor for crack detection or crack propagation. In the event of a high power transient electrical event such as lightning strike the conductive wire may be damaged due to arcing/sparking and the associated electrical heating.

It would therefore be highly desirable to have a method and apparatus for preventing ignition of volatile or explosive materials or gases in protective environments resulting from high current transient events causing arcing or sparking to electrical wires.

Further it would be highly desirable to have a method and an apparatus that would permit detection of the formation or propagation of cracks in structures exposed to a structural environment that is not susceptible to damage or destruction by electrical transient environments.

SUMMARY OF THE DISCLOSURE

The present disclosure generally provides a method and apparatus for installing wiring to structures exposed to high power transient electrical threats while preventing ignition within or damage to such structures without having to isolate or shield the wiring.

According to one exemplary embodiment of the disclosure, a highly resistive wire includes a non-metallic wire material, wherein the non-metallic wire material has a resistance higher than ten kilo-ohms per meter. The resistance of the highly resistive wire is between ten kilo-ohms per meter and one mega-ohm per meter. The highly resistive wire can be made of a carbon-loaded plastic material.

According to another embodiment of the disclosure, wiring for an electrical system carried by a structure that can prevent damage to the structure or the system in the event of a lightning strike includes a length of highly resistive wire, wherein the wire has a resistance of at least 10 kilo-ohms per meter. The structure includes an enclosure housing an explosive material, and may be a fuel tank containing a fuel. In one variation of this embodiment, the wiring has a resistance of between ten kilo-ohms per meter and 10 mega-ohms per meter. In another variation, the wiring comprises a carbon-loaded plastic material. The wiring can include a quantity of conductive particles in an amount sufficient to achieve a resistance of no less than ten kilo-ohms per meter. In another variation of this embodiment, the wiring can comprise a single conductive element surrounded by an insulative sheath. The exterior surface of the conductive element can be provided with a thin layer of a conductive or semi-conductive material, and can be provided as a film, such as a metal. In yet another variant of the embodiment, the wiring can comprise a plurality of elongated conductive elements bundled together and surrounded by an insulative sheath. The exterior surface of each of the conductive elements can be provided with a thin metal layer, and the thin metal layer can be a film.

In accordance with another embodiment of the disclosure, a method for monitoring structural damage to an element as a result of a lightning strike to the element includes a step of providing a highly resistive wire having a resistance greater than or equal to ten kilo-ohms per meter, a step of securing the wire to the element to be monitored, and a step of measuring the resistance of the wire to determine if the value has significantly changed, where a significant change in the resistance of the wire could indicate structural damage to the element. The method could include a further step of securing the wire to the element by embedding the wire within the element to be monitored.

In accordance with still another embodiment of the disclosure, a method for providing electrical power in an enclosure while preventing ignition of explosive or volatile material contained in the enclosure includes a step of securing at least a portion of highly resistive wire within the enclosure, where the wire has a resistance of at least 10 kilo-ohms per meter, and a further step of connecting the wire to an electric power source. The highly resistive wire has a resistance of not more than 10 mega-ohms per meter.

Further aspects of the system and the method of using the system and processing the information obtained through use of the system and method are disclosed herein. The features as discussed above, as well as other features and advantages of the present disclosure will be appreciated and understood by those skilled in the art from the following detailed description and drawings.

DETAILED DESCRIPTION OF THE DISCLOSURE

Embodiments of the present invention now will be described more fully hereinafter with reference to the accompanying drawing. However, many different embodiments are contemplated and the present disclosure should not be construed as limited to the embodiments set forth herein; rather, these embodiments are provided so that this disclosure will be thorough and complete and better convey the scope of the disclosure to those skilled in the art.

Figure 1:
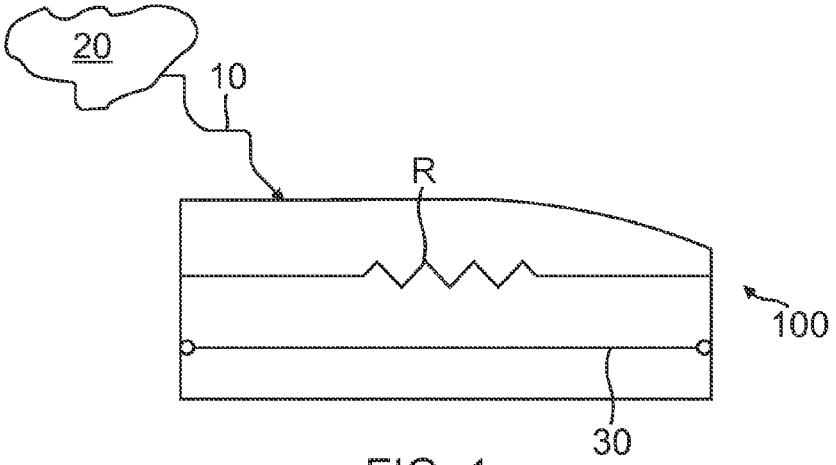
FIG. 1 is a schematic diagram showing a portion of a structure being hit by a lightning strike.

Referring first to FIG. 1, a lightning strike 10 is shown emanating from a cloud 20 hitting a structural element 100. For purposes of explanation, the structural element 100 may be a wall of an enclosure housing a flammable liquid or gas, or some combination of the two, such as would be found in a fuel tank in a vehicle, a machine, or even a storage container. The structural element possesses an inherent resistance, represented by the resistor symbol R. Wiring 30 is contained within or carried by the structural element 100.

Lightning strikes have been known to carry an electrical current on the order of 100,000 amps. The voltage developed inside a structural element when struck by the lightning is determined by the relationship V=IR and is 1000 volts/meter for a $1/100^{th}$ Ohm/meter resistance of the structure.

The resistance of conventional 26AWG signal wire is about 150 m-Ohms per meter; if accidentally shorted, the current carried would be over 6000 amps. This powerful spark would be more than sufficient to ignite fuel or fuel fumes. A wire with a resistance on the order of one mega-ohm per meter would only carry $1/1000^{th}$ of an amp. This magnitude of current would be too low to ignite the fuel or fuel fumes inside the fuel tank.

Further, the minimum ignition energy of a fuel-air mixture is approximately 0.2 mJ for an electrical spark. If one mA is continually conducted at the full voltage for a lightning strike of 100,000 amps for a 40 microsecond duration as specified in industry lightning test and certification standards, such as SAE ARP 5414 and ARP 5416, the total energy E produced is 0.04 mJ (where $E=I\times V\times T$, or $E=(1/1000)(1000)(40e^{-6})$). The energy in the arc or spark is only a fraction of this total depending, upon the resistance of the ionized spark gap. This value is well below the minimum energy required to ignite fuel or fuel fumes, and well below the minimum energy required to fully ionize an air gap to sustain an arc. Thus, a wire having a resistance of 1 mega-Ohms/meter would be inherently safe from a lightning strike and wires of resistances of 10000 Ohms/m to 10 mega-Ohm/m could also perform much better than traditional solid or stranded metal wiring.

Figure 2:
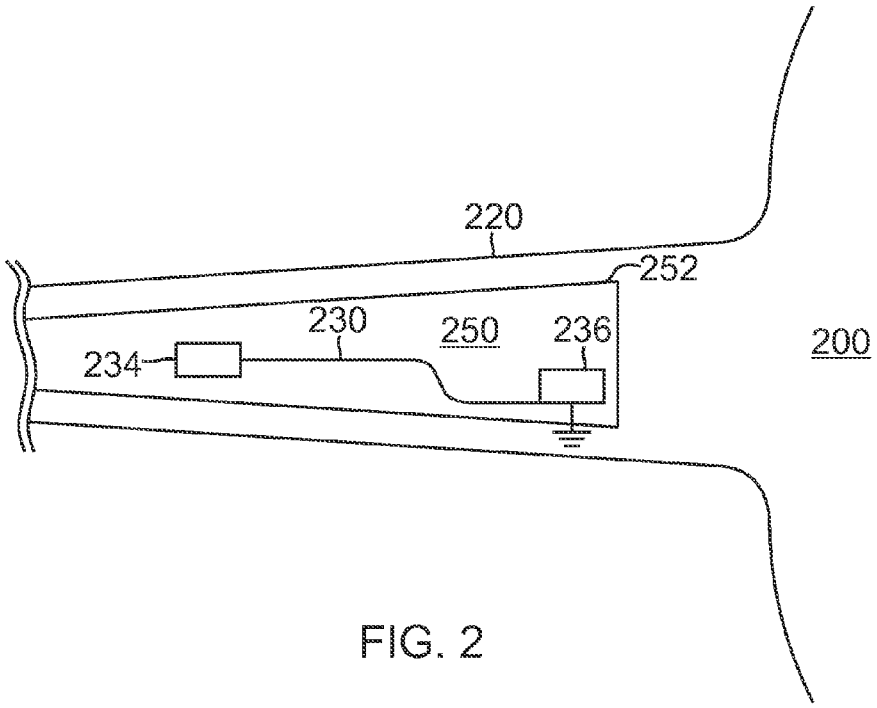
FIG. 2 is a partial cross-sectional view of an aircraft wing fuel tank with the resistive wiring of the present disclosure installed therein.

FIG. 2 depicts one application of the wire of the present disclosure in which at least a portion of the length of a highly resistive wire 230 according to the present disclosure is installed in, or in proximity to, the interior 250 of an enclosure 252 formed inside the wing 220 of an aircraft. The enclosure of this type forms a fuel tank, and typically contains flammable fuel or fuel fumes. The highly resistive wire 230, as used in this environment, prevents large transient currents such as those resulting from a lightning strike from coupling to such a resistive wire, and can ensure spark-free wire bundles in the event of a lightning strike or other high power electrical transient event.

The wire can be of nearly any cross-sectional configuration, and can be made of non-metal fibers such as glass or the synthetic fiber KEVLAR®. Preferably, the fibers, or a portion of the fibers, bear a very thin film of corrosion resistant metal, such as gold.

As shown in FIG. 2, the highly resistive wire 230 extends between a sensor 234 disposed at an outboard location within the enclosure 252 and an electronic measuring device 236 disposed at an inboard location in the vicinity of the fuselage or main body part 200 of the structure housing the enclosure 252. During a lightning strike, a large transient voltage develops between the wire 230 and the inner wall of the enclosure 252, but as a result of the high resistance of the wire 230, virtually no amount of current flows between the structure housing the enclosure and the wire 230.

It is to be noted that while the enclosure shown in FIG. 2 has been described above as a fuel tank in an aircraft, no limitation is intended by this disclosure to restrict the kind of vehicle, machine, or vessel that could house such an enclosure.

Further, the present disclosure contemplates embedding or otherwise attaching one or more resistive wires to a structure housing such enclosure in order to measure or determine destruction of any part of the structure due to the lightning strike. The wire according to the present disclosure would not allow any significant current from lightning strikes to transfer to or couple with the structure, and it would effectively prevent the structure from being degraded or destroyed as a result of a lightning strike. For example, in a structure made of composite materials, the wire would be used to determine if plies had separated or if any other structural damage had taken place, such as cracking or delamination, inasmuch as damage to the structure would most likely result in mechanical failure of the wire, and hence electrical failure of the wire.

Figure 3A:
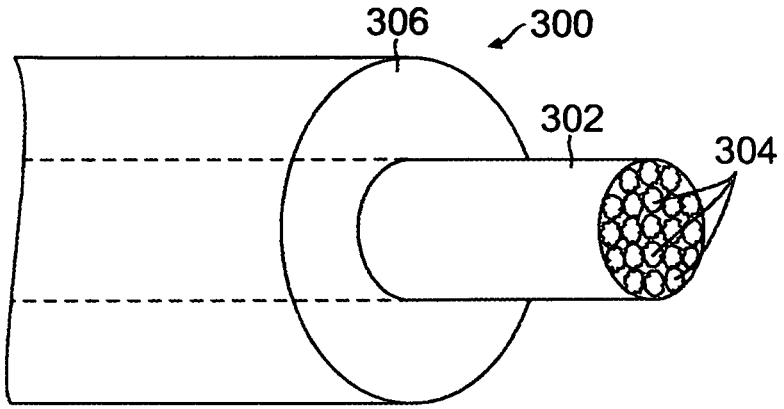
FIG. 3*a* shows a first embodiment of the resistive wire according to the present disclosure.

FIG. 3*a* illustrates a cross-section of a first embodiment of a resistive wire 300 contemplated by the present disclosure, and includes a cylindrical central core 302 made of a matrix of plastic material containing relatively evenly dispersed amount of conductive particles 304. The amount or density of conductive particles included is chosen to provide a desired resistivity. The conductive particles can be carbon, carbon black, or any other conductive material that provides desired properties, as for example metal particles. Surrounding the cylindrical central core 302 of the wire is a cylindrical electrically insulating and protective sheath 306.

Among the desired properties in a wire 300 as shown in FIG. 3*a* are strength and flexibility comparable to copper wiring, tolerance to fuel exposure, moisture, and tolerance of a wide range of operational temperatures. Most importantly the resistance of the wire should be greater than 10,000 ohms to prevent current coupling to the wire but not more than 10 M ohms to ensure enough conductivity for low level power or signals. As another example of construction of wire 302, the material can be Nylon-6 plastic material loaded with conductive particles.

Figure 3B:
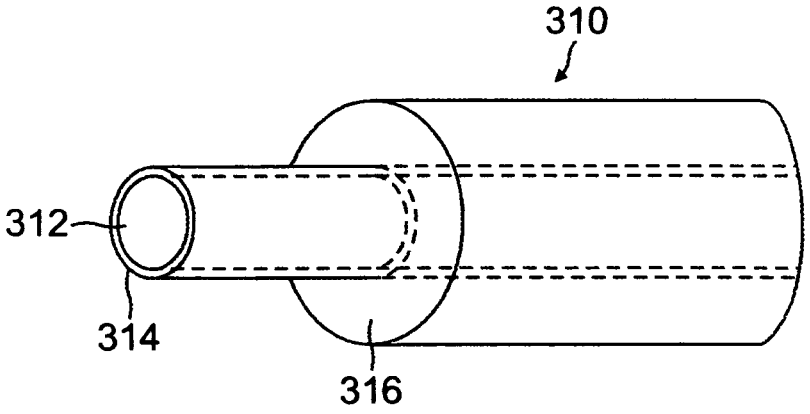
FIG. 3*b* shows a second embodiment of the resistive wire according to the present disclosure.

FIG. 3*b* shows a solid wire 310 consisting of a central strand 312 of non-conductive material. The material may be plastic, glass, ceramic, etc. The strand 312 is coated with a very thin metal layer or film 314. The thickness of the layer 314 is chosen to give the wire a resistance of 10 kilo-ohms per meter to 10 mega-ohms per meter.

Figure 3C:
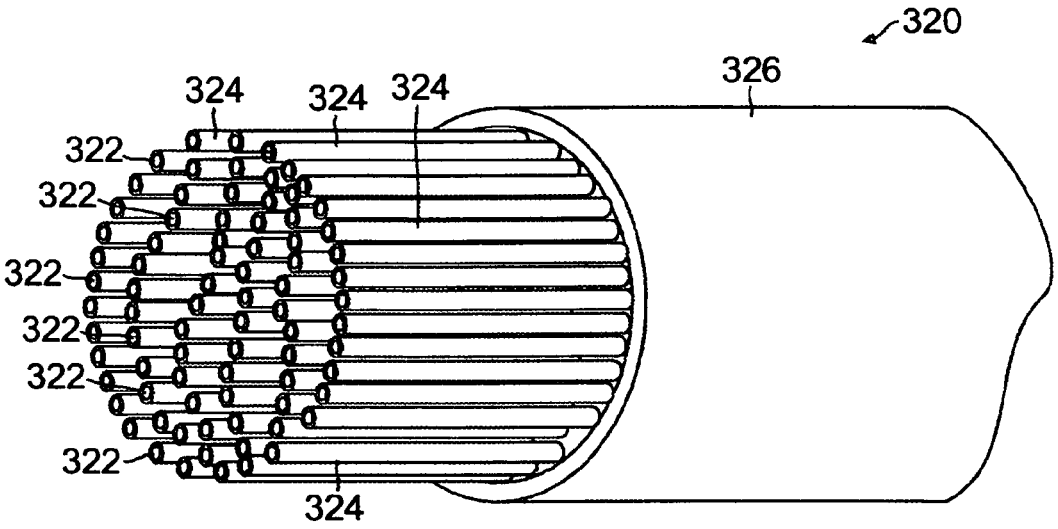
FIG. 3*c* shows a third embodiment of the resistive wire according to the present disclosure.

FIG. 3*c* shows a highly resistive wire 320 including multiple strands of wire elements 322 surrounded by an encircling layer of electrically insulating material 326. Each of the strands is coated with a thin layer 324 of metal, or a semiconductive material. The thickness of the layer 324 is chosen such that, collectively, the wire strand elements 322 exhibit a resistance of 10 kilo-ohm per meter to 10 mega-ohm per meter.

Figure 3D:
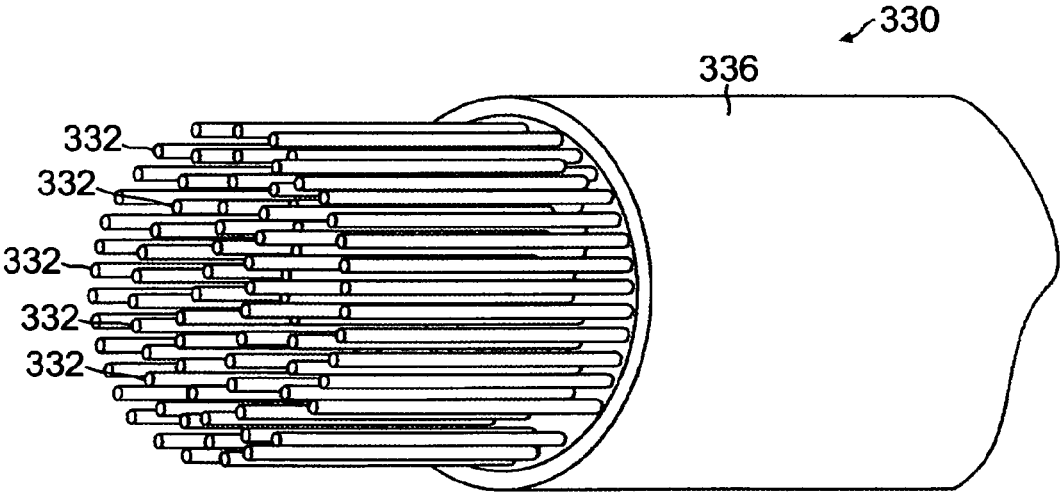
FIG. 3*d* shows a fourth embodiment of the resistive wire according to the present disclosure.

FIG. 3*d* shows an electrical wire 330 consisting of a cylindrical layer 336 of insulation surrounding a plurality of wires 332 made of material that is inherently resistive. Materials such as boron, silicon, carbon, or compounds such as silicon carbide, are naturally very resistive. These materials can be drawn into wires or fibers and bundled (such as is shown in FIG. 3*d*) to produce electrical wiring that exhibits resistance of 10 kilo-ohm per meter to 10 mega-ohm per meter.

Other uses of the resistive wire of the present disclosure include 4-point probe wiring for capacitive fuel probes, wiring to deliver and receive discrete or digitized signals, as well as high and low level analog signals, certain digital signals associated with high impedance inputs and in connection with ultra low power devices, use as a digital strain gauge, use as a temperature, moisture, or flight test sensor.

It will be understood by those skilled in the art that various changes may be made and equivalents may be substituted for elements thereof without departing from the scope of this disclosure. In addition, many modifications may be made to adapt a particular situation or material to the teachings of the disclosure without departing from the essential scope thereof. Therefore, it is intended that this disclosure not be limited to the particular embodiment disclosed as the best mode contemplated for carrying out this invention, but that the disclosure will include all embodiments falling within the scope of the appended claims.

The invention claimed is:

1. A highly resistive wire for conducting power and electronic signals within a fuel tank manufactured from composite materials, said highly resistive wire comprising:

a non-metallic core material having a resistance per unit length distributed evenly along said core, said resistance per unit length higher than ten kilo-ohms per meter, wherein the core material is coated with at least one layer of a metallic film, wherein the highly resistive core extends between a sensor and an electronic measuring device that are both positioned within the fuel tank that houses a fuel, and wherein the electronic measuring device is positioned on an inboard region of the fuel tank.

2. The highly resistive wire of claim 1, wherein the resistance is between ten kilo-ohms per meter and one mega-ohm per meter.

3. The highly resistive wire of claim 1, wherein the non-metallic core material is at least one of plastic, glass, and ceramic.

4. A wiring scheme for an electrical system carried by a structure manufactured from composite materials, the wiring scheme preventing damage to the structure or the system in the event of a lightning strike, the wiring scheme comprising:

a length of highly resistive wire having a resistance per unit length distributed evenly along said wire, said resistance per unit length comprising at least ten kilo-ohms per meter and comprising a non-metallic core material, wherein the highly resistive wire comprises a first end coupled to a sensor and a second end coupled to an electronic measuring device, wherein the sensor and the electronic measuring device are both positioned within a fuel tank that houses a fuel such that an entire length of said highly resistive wire is positioned within the fuel tank, and wherein the electronic measuring device is positioned on an inboard region of the fuel tank.

5. The wiring scheme of claim 4, wherein the length of highly resistive wire has a resistance of between ten kilo-ohms per meter and ten mega-ohms per meter.

6. The wiring scheme of claim 4, wherein the non-metallic core material is coated with at least one layer of a metallic film.

7. The wiring scheme of claim 6, wherein the thickness of the at least one of the metal layer and the film is sufficient to achieve a resistance of no less than ten kilo-ohms per meter.

8. The wiring scheme of claim 6, wherein the at least one of the metal layer and the film is surrounded by an insulative sheath.

9. The wiring scheme of claim 4, wherein the sensor is disposed at an outboard region of the fuel tank.

10. A method for monitoring structural damage to an enclosure that houses an explosive material as a result of a lightning strike to the enclosure, said method comprising:

providing a highly resistive wire including a non-metallic core material, the highly resistive wire having a resistance per unit length distributed evenly along said core, said resistance per unit length greater than or equal to ten kilo-ohms per meter, coupling a first end of the highly resistive wire to a sensor and a second end of the highly resistive wire to an electronic measuring device, wherein the sensor and the electronic measuring device are both positioned within a fuel tank that houses a fuel such that an entire length of said highly resistive wire is positioned within the fuel tank and wherein the electronic measuring device is positioned on an inboard region of the fuel tank, securing the highly resistive wire to the fuel tank, wherein the fuel tank is manufactured from composite materials, and measuring the resistance of the highly resistive wire to determine if the resistance has significantly changed, whereby a significant change in the resistance of the highly resistive wire would indicate structural damage to the fuel tank.

11. The method of claim 10, wherein the step of securing the highly resistive wire to the fuel tank comprises embedding the highly resistive wire within a structural wall of the fuel tank.

12. A method of providing electrical power in an enclosure while preventing ignition of explosive or volatile material contained in the enclosure, comprising:

securing at least a portion of highly resistive wire within a fuel tank that houses a fuel and is manufactured from composite materials, the highly resistive wire including a non-metallic core material, the highly resistive wire having a resistance per unit length distributed evenly along said core, said resistance per unit length at least ten kilo-ohms per meter, and connecting a first end of the highly resistive wire to a sensor and a second end of the highly resistive wire to an electronic measuring device, wherein the sensor and the electronic measuring device are both positioned within the fuel tank such that an entire length of said highly resistive wire is positioned within the fuel tank, wherein the electronic measuring device is positioned on an inboard region of the fuel tank.

13. The method of claim 12, wherein the highly resistive wire has a resistance of not more than ten mega-ohms per meter.

14. The highly resistive wire of claim 1, wherein said non-metallic core material comprises a plurality of wire elements.

15. The highly resistive wire of claim 14, wherein each wire element of said plurality of wire elements comprises said at least one layer of a metallic film.

16. The highly resistive wire of claim 14, wherein each wire element of said plurality of wire elements is fabricated from at least one of boron, silicon, carbon, and any combination thereof.

17. The highly resistive wire of claim 1 further comprising a first end coupled to the sensor and a second end coupled to the electronic measuring device such that an entire length of said highly resistive wire is positioned within the fuel tank.

18. The highly resistive wire of claim 1, wherein at least a portion of said non-metallic core material is embedded within a structural wall of the fuel tank.

19. The wiring scheme of claim 4, wherein said non-metallic core material comprises a plurality of wire elements, wherein each wire element of said plurality of wire elements is fabricated from at least one of boron, silicon, carbon, and any combination thereof.

20. The wiring scheme of claim 4, wherein at least a portion of said non-metallic core material is embedded within a structural wall of the fuel tank.

* * * * *